United States Patent [19]

Villeval

[11] 4,422,502

[45] Dec. 27, 1983

[54] INTEGRATED WATER BOX AND EXPANSION CHAMBER DEVICE FOR A HEAT EXCHANGER SUCH AS THE RADIATOR IN THE COOLING CIRCUIT OF AN INTERNAL COMBUSTION ENGINE

[75] Inventor: Denis Villeval, Maurepas, France

[73] Assignee: Valeo, Paris, France

[21] Appl. No.: 397,216

[22] Filed: Jul. 12, 1982

[30] Foreign Application Priority Data

Jul. 16, 1981 [FR] France ..... 81 13891

[51] Int. Cl.[3] ..... F01P 11/02

[52] U.S. Cl. ..... 165/104.32; 165/DIG. 24; 123/41.51; 123/41.54

[58] Field of Search ..... 165/104.32, 104.31, 165/DIG. 24; 123/41.51, 41.54, 41.44

[56] References Cited

U.S. PATENT DOCUMENTS

| | | | |
|---|---|---|---|
| 1,700,270 | 1/1929 | Muir | 123/41.21 |
| 3,623,462 | 11/1971 | Anders et al. | 123/41.51 X |
| 4,200,065 | 4/1980 | Buddenhagen | 123/41.51 X |
| 4,366,858 | 1/1983 | Moranne | 165/104.32 |

*Primary Examiner*—Albert W. Davis, Jr.

*Attorney, Agent, or Firm*—Dennison, Meserole, Pollack & Scheiner

[57] ABSTRACT

The expansion chamber (25) and the water box (24) are interconnected by a degassing passage or duct (28) and by a suction orifice (29). The expansion chamber also has a bottom end which is connected (via 27) to a suction inlet (21) of a pump (11) for circulating liquid in said cooling circuit. One way valve means (40) are provided to close said suction orifice to prevent liquid in the water box from flowing into the expansion chamber and to open said orifice to enable liquid to flow in the opposite direction. The invention is particularly applicable to degassing the cooling liquid while a diesel engine is warming up from a cold start.

7 Claims, 4 Drawing Figures

FIG. 1
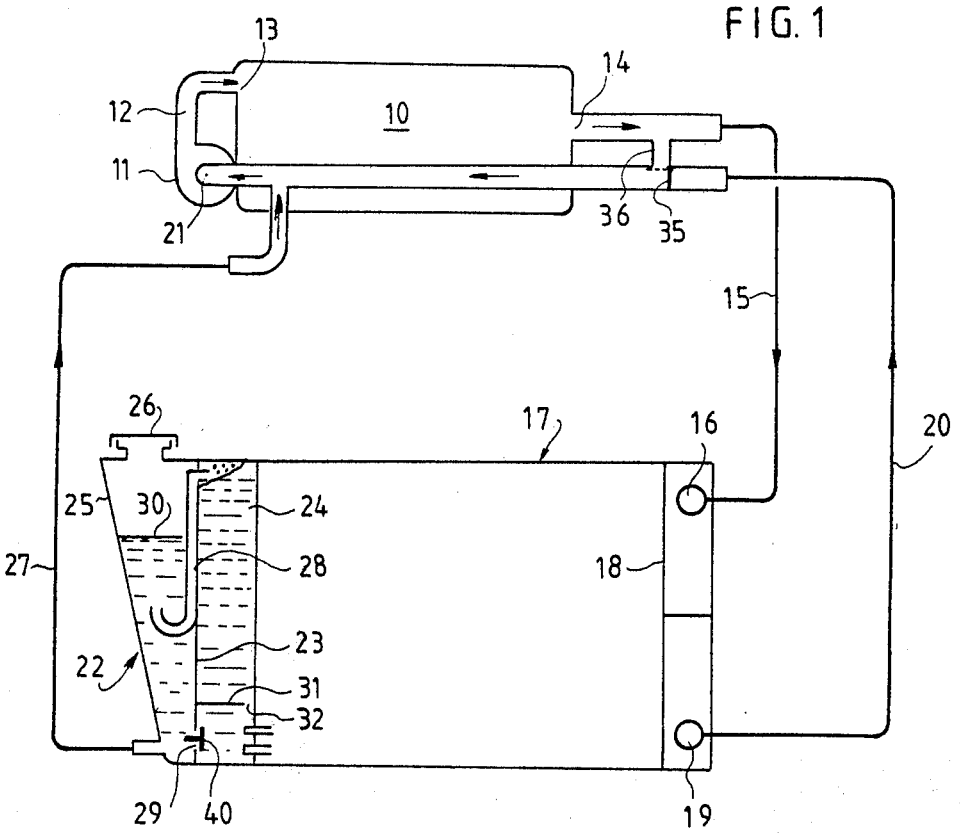
FIG. 2
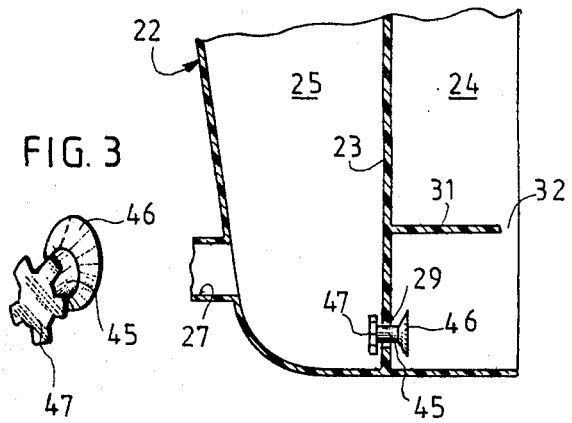
FIG. 3
FIG. 4
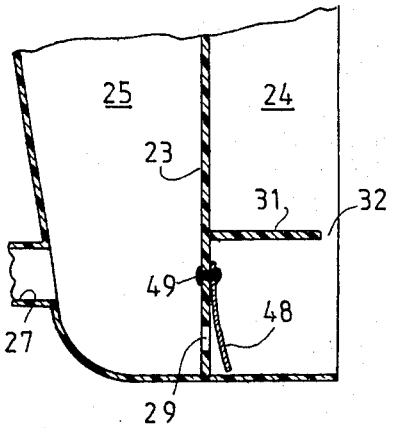

INTEGRATED WATER BOX AND EXPANSION CHAMBER DEVICE FOR A HEAT EXCHANGER SUCH AS THE RADIATOR IN THE COOLING CIRCUIT OF AN INTERNAL COMBUSTION ENGINE

The present invention relates to an integrated water box and expansion chamber device for a heat exchanger such as the radiator in the cooling circuit of an internal combustion engine of a motor vehicle.

BACKGROUND OF THE INVENTION

Generally speaking, such a circuit includes a pump for circulating the cooling liquid, a radiator or heat exchanger in which the liquid circulates, an expansion chamber, and ducts connecting these various components to each other and to the engine. The duct for returning cooling liquid to the engine may include a thermostatically-controlled valve for closing said duct when the temperature of the liquid is low (i.e. until the engine reaches its normal operating temperature). In such an arrangement, the cooling liquid leaving the engine is generally returned directly to the engine, short-circuiting the heat exchanger. Said valve is arranged to re-establish the normal cooling liquid circuit once the temperature of the cooling liquid reaches a predetermined value.

However, even while the temperature of the engine is rising, it is advantageous, particularly in the case of diesal engines, to leave a small flow of cooling liquid thru the radiator to ensure that the liquid is degassed and to avoid the formation of hot points in the engine block. Degassing takes place in the normal manner by means of a duct connecting the upper portion of one of the radiator's water boxes to the expansion chamber. The water box used is the one which does not have the liquid inlet to the radiator associated therewith. The lower portion of the expansion chamber is connected to the suction inlet of the cooling liquid circulation pump in order to ensure the desired small flow of liquid.

Implementing this method gives satisfactory results so long as the expansion chamber is a unit independent from the radiator's water boxes. However, when the expansion chamber is part of one of said water boxes, and when it is connected to the other portion of the water box by an upper degassing duct and by a lower suction orifice, it has been observed that degassing efficiency can be greatly reduced while the operating temperature of the engine is rising, i.e. while the thermostatically-controlled valve closes the outlet tube from the radiator.

Preferred embodiments of the present invention avoid this drawback in such an integrated water box and expansion chamber device.

SUMMARY OF THE INVENTION

The present invention provides an integrated water box and expansion chamber device for a heat exchanger such as the radiator in the cooling circuit of an internal combustion engine, wherein the expansion chamber and the water box are interconnected by a degassing passage or duct and by a suction orifice, the expansion chamber also having a bottom end which is connected to a suction inlet of a pump for circulating liquid in said cooling circuit, one way valve means being provided to close said suction orifice to prevent liquid in the water box from flowing into the expansion chamber and to open said orifice to enable liquid to flow in the opposite direction.

Thus, in a device in accordance with the invention, the liquid cannot pass thru the suction orifice connecting the expansion chamber to the water box in the direction from the water box towards the expansion chamber, whereby the small flow of liquid passing thru the heat exchanger while the engine is warming up can only pass thru the expansion chamber via the degassing duct, thereby ensuring proper degassing of the cooling liquid.

In contrast, since said one way valve means do not prevent the liquid from circulating in the opposite direction thru said suction orifice, the expansion chamber can continue to perform its normal function once the engine has reached its normal operating temperature (i.e. when the thermostatically-controlled valve has re-opened the outlet duct from the radiator).

BRIEF DESCRIPTION OF THE DRAWING

Embodiments of the invention are described by way of example with reference to the accompanying drawing, in which:

FIG. 1 is a diagrammatic view of the cooling circuit of an internal combustion engine including a device in accordance with the invention;

FIG. 2 is a partial section thru a first embodiment of the invention;

FIG. 3 is a perspective view of a non-return valve used in the FIG. 2 embodiment; and FIG. 4 is a similar view to FIG. 2 showing a second embodiment of the invention.

MORE DETAILED DESCRIPTION

Reference is made initially to FIG. 1 which is a diagram of the cooling circuit of an internal combustion engine 10, and in particular of a diesel engine.

The cooling circuit of this engine comprises a pump 11 for circulating the liquid, and having an outlet orifice 12 connected to a liquid inlet orifice 13 to the engine.

The engine has a liquid outlet orifice 14 connected via a duct 15 to a liquid inlet tube 16 to the radiator 17. The inlet tube 16 is provided on a first water box 18 of said radiator, which water box also provides a liquid outlet tube 19 from the radiator. The outlet tube 19 is connected via a duct 20 to the suction orifice 21 of the pump 11.

The radiator 17 is fitted with a housing 22 at its end opposite to the end fitted with the first water box 18. The housing 22 is divided by an internal partition 23 into a second water box 24 and an expansion chamber 25. The top of the expansion chamber 25 is closed by a stopper 26 which includes calibrated valves for releasing excessively high under pressures and over pressures, and its bottom portion is connected via a duct 27 to the suction orifice 21 of the pump 11.

The second water box 24 is connected to the expansion chamber 25 via a degassing duct 28 in the upper portion thereof and via a suction orifice 29 in the lower portion. The degassing duct 28 leaves the top of the second water box 24 and opens out in the expansion chamber 25 below the level 30 of liquid contained therein. The water box 24 is delimited, at its bottom end, by a transverse partition or wall 31 which extends above the suction orifice 29 and leaves a communicating passage 32 between the upper and lower portions of the water box 24, said portions being situated on either side of said partition or wall 31.

A thermostatically-controlled valve 35 is provided between the liquid outlet 14 from the engine 10 and the duct 20 leading to the outlet 19 from the heat exchanger to the suction inlet 21 of the pump 11. When the temperature of the cooling liquid is below a predetermined value, the valve 35 opens a link 36 between the outlet orifice 14 and the duct 20 leading towards the suction orifice 21 of the pump 11, while closing the duct 20 upstream therefrom. Once the temperature of the cooling liquid reaches a determined value, the thermostatically-controlled valve 35 closes the link 36 and opens the duct 20.

The circuit which has just been described operates as follows:

When the engine is cold and has not reached its normal operating temperature, the valve 35 opens the link 36 and closes the duct 20 upstream therefrom. Under these conditions the cooling liquid circulated by the pump 11 passes thru the engine 10, leaves via the outlet duct 14, circulates along the duct 15, enters the first water box 18 via the inlet tube 16, circulates thru the core of radiator tubes 17 to arrive in the second water box 14, and can only return to the suction orifice 21 of the pump 11 via the duct 27 which connects the lower portion of the expansion chamber 25 to said suction orifice 21. The cooling liquid also circulates via the link duct 36 to flow directly to the suction orifice 21 of the pump 11. The bores of the different ducts are chosen in such a manner that the flow of liquid passing thru the radiator 17 is much less than the flow passing thru the link duct 36. This small flow of liquid passing thru the radiator 17 contains bubbles of air or gas which collect in the top left corner of the water box 24 and which can thus be sucked via the degassing duct 28 into the upper portion of the expansion chamber 25.

To ensure proper degassing of the liquid, the invention provides for the suction orifice 29 to be closed in a sealed manner during said start-up conditions by a non-return valve 40. The valve is closed under such circumstances by the suction provided by the flow of liquid along the duct 27 to the suction orifice 21. The liquid cannot then circulate thru the water box 24 via the pasage 32 and the suction orifice 29 to reach the lower portion of the expansion chamber 25. It should be observed, that the orifice 29 is closed by the non-return valve because of the suction due to the liquid flowing in the duct 27.

Once the engine has reached its normal operating temperature, the thermostatically-controlled valve 35 closes the link duct 36 and fully opens the duct 20 from the outlet 19 from the radiator 17 to the suction orifice 21 to the pump 11. In this condition, all the cooling liquid from the engine passes thru the radiator 17 passing via the inlet tube 16, the water box 18, the radiator core, the water box 24, and returning in the opposite direction again via the core of radiator to reach the outlet tube 19, and then the suction inlet 21 to the pump 11 via the duct 20. Under these conditions the valve 40 opens the suction orifice 29 to enable the expansion chamber 21 to perform its normal function. By a suitable choice for the bore of the link duct 27 between the lower portion of the expansion chamber 25 and the suction inlet to the pump 11, the flow of liquid along said link duct 27 is much less than the flow of liquid along the link duct 20. The non-return valve 40 moves to open the suction orifice 29 because the suction provided by the liquid circulating in the heat exchanger tubes is much greater than the suction provided by the liquid circulating in the duct 27.

Reference is now made to FIGS. 2 to 4 which show two particular embodiments of the non-return valve 40 in accordance with the invention.

IN FIGS. 2 and 3 the non-return valve is mounted in the orifice 29 itself and comprises a cylindrical peg 45 having one end in the water box 24 and its other end in the expansion chamber 25. The water box end is capped with a frusto-conical portion 46 while the other end is provided with radially extending fingers 47 that are resiliently deformable and enable the peg to be inserted thru the orifice 29 from the water box side. The diameter of the peg 45 is less than the diameter of the orifice 29 while the frusto-conical portion 46 is suitably shaped for closing the orifice 29 in a substantially water-tight manner when the valve is moved towards the left as shown in FIG. 2. However, when the valve is moved to the right of FIG. 2, the liquid may flow from the expansion chamber 25 into the water box 24 via the orifice 29, passing around the peg 45.

In the embodiment shown in FIG. 4, the non-return valve is a simple flap 48 of flexible material, having a larger surface area than the orifice 29 and which is fixed on the water box side to the partition 23 separating the water box from the expansion chamber. There is at least one fixing point 49 situated slightly above the orifice 29. In this position the flexible flap 48 extends substantially over the orifice 29 and is capable of completely covering it. When the flap is applied against the wall 23, it closes the orifice 29 and prevents any circulation of liquid from the water box 24 into the expansion chamber 25. However, it does not prevent liquid from circulating in the opposite direction thru the orifice 29.

The flap 49 may be a simple sheet of metal foil fixed along its upper edge at one or more points 49 by any suitable means, e.g. rivetting, glueing, welding, etc. The flap 48 may also have one or more holes near its upper edge to receive and snap-fasten onto one or more fingers or lugs projecting from the wall 23.

The invention is in no way limited to the embodiments which have been described and shown, and numerous variations are possible within the scope of the claims. In particular, many types of non-return valve can be used for selectively closing the orifice 29 in the wall 23, it is sufficient for such non-return valves to prevent liquid from circulating through the orifice 29 from the water box 24 towards the expansion chamber 25, while permitting such circulation of liquid in the opposite direction.

The invention is also applicable to the case where the water box and contiguous expansion chamber include the inlet tube for liquid flowing into the heat exchanger. In this case, the upper portion of the other water box needs to be connected to the expansion chamber by a degassing duct, for example via an upper tube of the core 17.

The invention is particularly applicable to diesel engines, but it may also be applied to gasoline engines.

I claim:

1. Integrated water box and expansion chamber device for a heat exchanger such as the radiator in the cooling circuit of an internal combustion engine, wherein the expansion chamber and the water box are interconnected by a degassing passage or duct and by a suction orifice, the expansion chamber also having a bottom end which is connected to a suction inlet of a pump for circulating liquid in said cooling circuit, one way valve means being provided to close said suction orifice to prevent liquid in the water box from flowing into the expansion chamber and to open said orifice to enable liquid to flow in the opposite direction.

2. A device according to claim 1, wherein said one way valve means are movable between a first position and a second position, said first position enabling liquid to flow from the expansion chamber to the water box through the suction orifice, and said second position preventing such flow, said valve means being moved between said first and second postitions by the beginning of any liquid flow through said suction orifice in one direction or the other.

3. A device according to claim 1, wherein said one way valve means close said suction orifice when circulation of liquid through the heat exchanger is reduced, e.g. by means of a thermostatically controlled valve.

4. A device according to claim 1, wherein said one way valve means comprise a non-return valve.

5. A device according to claim 4, wherein said non-return valve is constituted by a flexible flap disposed inside the water box in such a manner as to extend over said orifice and rest against the edges thereof to close it in a substantially sealed manner.

6. A device according to claim 4, wherein said non-return valve comprises a peg inserted in said orifice having one end in the water box and the other end in the expansion chamber, said one end having a frusto-conical orifice-stopping member thereon, and the other end having resiliently deformable fingers projecting radially therefrom.

7. A device according to claim 6, wherein said non-return valve is inserted into said orifice via its end having the resiliently deformable fingers.

* * * * *